US008457506B2

(12) United States Patent
Abe et al.

(10) Patent No.: US 8,457,506 B2
(45) Date of Patent: Jun. 4, 2013

(54) IMAGE-FORMING DEVICE

(75) Inventors: Koji Abe, Nagoya (JP); Takashi Shimizu, Nagoya (JP); Haruyo Endo, Aichi-ken (JP); Yoshiki Mori, Konan (JP); Jun Hatta, Nagoya (JP); Shinji Ogawa, Ama (JP); Mitsuyoshi Matsuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 264 days.

(21) Appl. No.: 13/010,430

(22) Filed: Jan. 20, 2011

(65) Prior Publication Data

US 2011/0182593 A1 Jul. 28, 2011

(30) Foreign Application Priority Data

Jan. 28, 2010 (JP) ..... 2010-017267

(51) Int. Cl.
*G03G 15/04* (2006.01)

(52) U.S. Cl.
USPC ..... 399/11; 399/119

(58) Field of Classification Search
USPC ..... 399/11, 119
See application file for complete search history.

(56) References Cited

U.S. PATENT DOCUMENTS

| | | | | |
|---|---|---|---|---|
| 5,619,307 | A * | 4/1997 | Machino et al. | 399/11 |
| 6,055,392 | A * | 4/2000 | Huver et al. | 399/98 |
| 6,324,350 | B1 * | 11/2001 | Ito et al. | 399/12 |
| 6,459,859 | B1 * | 10/2002 | Regelsberger et al. | 399/11 |
| 6,883,892 | B2 * | 4/2005 | Sievert et al. | 347/19 |
| 2007/0098471 | A1 | 5/2007 | Kawamoto et al. | |
| 2007/0147881 | A1 | 6/2007 | Okabe et al. | |
| 2009/0097869 | A1 | 4/2009 | Kono et al. | |

FOREIGN PATENT DOCUMENTS

| | | | |
|---|---|---|---|
| CN | 1955855 | A | 5/2007 |
| CN | 101706641 | A | 5/2010 |
| JP | H05-034935 | A | 2/1993 |
| JP | 2003-295555 | A | 10/2003 |
| JP | 2006-171606 | A | 6/2006 |
| JP | 2007-199649 | A | 8/2007 |
| JP | 2008-164708 | A | 7/2008 |
| JP | 2009-098186 | A | 5/2009 |

OTHER PUBLICATIONS

State Intellectual Property Office of the People'S Republic of China, The First Office Action in counterpart Patent Application No. CN 201110038655.4 (mailing date Mar. 22, 2013).

* cited by examiner

*Primary Examiner* — Ryan Walsh
(74) *Attorney, Agent, or Firm* — Baker Botts L.L.P.

(57) ABSTRACT

An image-forming device includes a main casing, a drum unit, an image-forming unit, and a transfer unit. The drum unit is detachable from the main casing and includes a photosensitive drum having a rotational axis extending in an axis direction. The drum unit is formed with a plurality of symbols juxtaposed along the axis direction. The image-forming unit forms an image on the photosensitive drum in an image-forming mode. The transfer unit transfers the first developer image onto the photosensitive drum onto a sheet. The image-forming unit forms a first developer image on the photosensitive drum in a maintenance mode. The first developer image transferred onto the sheet divides the sheet into a plurality of regions along the axis direction, the plurality of regions corresponding to the plurality of symbols, respectively.

10 Claims, 7 Drawing Sheets

IMAGE-FORMING DEVICE

CROSS REFERENCE TO RELATED APPLICATION

This application claims priority from Japanese Patent Application No. 2010-017267 filed Jan. 28, 2010. The entire content of this application is incorporated herein by reference.

TECHNICAL FIELD

The present invention relates to an image-forming device such as a laser printer.

BACKGROUND

One example of a laser printer well known in the art is a tandem-type color laser printer having four photosensitive drums arranged in tandem and parallel to one another. The photosensitive drums are provided respectively for the colors yellow, magenta, cyan, and black.

Surrounding each of the photosensitive drums is a corresponding Scorotron charger, a developing roller, a transfer roller, and the like.

During an image-forming operation, each charger charges the surface of the corresponding photosensitive drum with a positive polarity through corona discharge while the photosensitive drum rotates. The charged surface of the photosensitive drum is then selectively exposed to a laser beam that eliminates the charge in the exposed areas, forming an electrostatic latent image on the surface of the photosensitive drum.

As the photosensitive drum continues to rotate, bringing the electrostatic latent image into confrontation with the developing roller, the developing roller supplies toner to the electrostatic latent image. The toner develops the latent image into a toner image. Thus, a toner image is now carried on the surface of the photosensitive drum.

As the photosensitive drum continues to rotate, bringing the toner image to a position opposite the corresponding transfer roller, a sheet of paper is conveyed to the contact area between the photosensitive drum and transfer roller in synchronization with the timing of the rotating toner image. The toner image is transferred from the surface of the photosensitive drum onto the sheet of paper passing between the photosensitive drum and transfer roller, forming an image on the paper.

SUMMARY

With this type of laser printer, toner occasionally sticks to the surface of the photosensitive drum. If this occurs, the toner stuck to the surface of the photosensitive drum may be deposited on the paper during an image-forming operation, producing spots or blemishes on the paper.

However, it is not easy for the non-technical user to identify the position on the photosensitive drum at which toner is sticking based on the position of spots formed on a sheet of paper, and it can be quite time-consuming for the user to remove toner stuck to the photosensitive drum. Identifying the source of the spots is particularly difficult in a color laser printer because the printer has a plurality of photosensitive drums. Therefore, the user must first identify which photosensitive drum is responsible for the spots and then identify the position on the photosensitive drum at which the toner is stuck.

In view of the foregoing, it is an object of the present invention to provide an image-forming device configured such that a user can easily identify the location of toner or other foreign matter that is stuck on the surface of a photosensitive drum.

In order to attain the above and other objects, the invention provides an image-forming device including a main casing, a drum unit, an image-forming unit, and a transfer unit. The drum unit is detachable from the main casing and includes a photosensitive drum having a rotational axis extending in an axis direction. The drum unit is formed with a plurality of symbols juxtaposed along the axis direction. The image-forming unit forms an image on the photosensitive drum in an image-forming mode. The transfer unit transfers the image onto the photosensitive drum onto a sheet. The image-forming unit forms a first developer image on the photosensitive drum in a maintenance mode. The first developer image transferred onto the sheet divides the sheet into a plurality of regions along the axis direction, the plurality of regions corresponding to the plurality of symbols, respectively.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a preferred embodiment of the present invention will be described while referring to the accompanying drawings.

1. Overall Structure of a Printer

Figure 1:
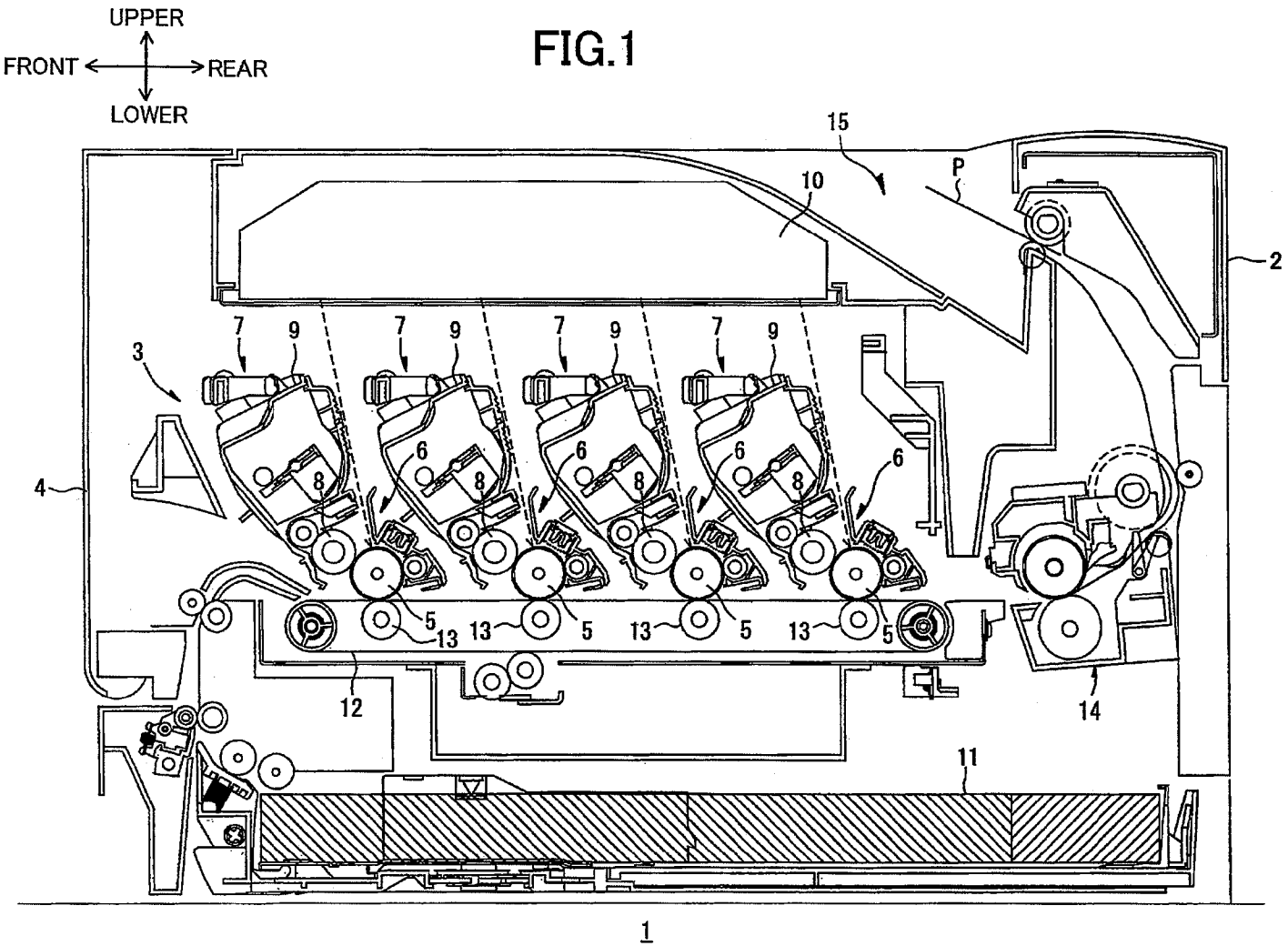
FIG. 1 is a side cross-sectional view of a printer according to an embodiment of the present invention.

The image-forming device according to the preferred embodiment is a tandem-type color printer 1. As shown in FIG. 1, the printer 1 has a main casing 2, and a drum unit 3 that mounts in the main casing 2. A front cover 4 is provided on one side wall of the main casing 2. By opening the front cover 4, the drum unit 3 can be mounted in and removed from the main casing 2.

In the following description, the side of the printer 1 on which the front cover 4 is provided (the left side in FIG. 1) will be called the "front side" and the opposite side (the right side in FIG. 1) will be called the "rear side." Left and right sides of the printer 1 will be specified based on the perspective of a user facing the front side of the printer 1.

The drum unit 3 is provided with four photosensitive drums 5 respectively corresponding to the colors black, yellow, magenta, and cyan. The photosensitive drums 5 are arranged in parallel to each other and are juxtaposed at regular intervals in the front-to-rear direction. The arrangement of the photosensitive drums 5 with respect to their toner color is, in order from front to rear, black, yellow, magenta, and cyan.

The drum unit 3 also includes a Scorotron charger 6 and a developer cartridge 7 for each of the photosensitive drums 5. The developer cartridge 7 is configured of a developing roller 8 for supplying toner to the corresponding photosensitive drum 5, and a cartridge frame 9 for holding the developing roller 8 such that the bottom peripheral surface of the developing roller 8 remains exposed in the bottom thereof. Each of the developer cartridges 7 is detachably mounted in the drum unit 3.

An exposure device 10 is provided above the drum unit 3. The exposure device 10 emits four laser beams corresponding to the four colors.

As each of the photosensitive drums 5 rotates, the corresponding charger 6 applies a uniform charge to the surface of the photosensitive drum 5 through corona discharge. Thereafter, the exposure device 10 selectively exposes the surface of each photosensitive drum 5 with a laser beam, thereby selectively removing the electrical charge from the exposed areas to form an electrostatic latent image on the surface of the photosensitive drum 5. As the photosensitive drum 5 continues to rotate, and the latent image on the surface of the photosensitive drum 5 rotates toward the developing roller 8, the developing roller 8 supplies toner to the latent image, forming a toner image on the surface of the photosensitive drum 5.

Here, four LED arrays may be provided, one for each photosensitive drum 5, in place of the exposure device 10.

A paper cassette 11 for accommodating sheets of a paper P is disposed in the bottom section of the main casing 2. The paper P accommodated in the paper cassette 11 is conveyed onto a conveying belt 12 by various rollers. The conveying belt 12 is arranged so that its top surface confronts the bottom peripheral surfaces of the four photosensitive drums 5. Four transfer rollers 13 are disposed inside the conveying belt 12 at positions confronting each of the photosensitive drums 5 through the upper portion of the conveying belt 12. Once a sheet of paper P is conveyed onto the conveying belt 12, the conveying belt 12 carries the sheet sequentially through positions between the conveying belt 12 and each of the photosensitive drums 5. At this time, a transfer bias applied by each transfer roller 13 transfers the toner image carried on the respective photosensitive drum 5 to the sheet of paper P as the toner image rotates into the sheet.

A fixing unit 14 is disposed on the downstream end of the conveying belt 12 with respect to the direction that the paper P is conveyed. After toner images are transferred onto the paper P, the paper P is conveyed to the fixing unit 14, where the toner images are fixed to the sheet by heat and pressure. After the toner images are fixed in the fixing unit 14, variously rollers discharge the sheet onto a discharge tray 15 formed on the top surface of the main casing 2.

2. Drum Unit

Figure 2:
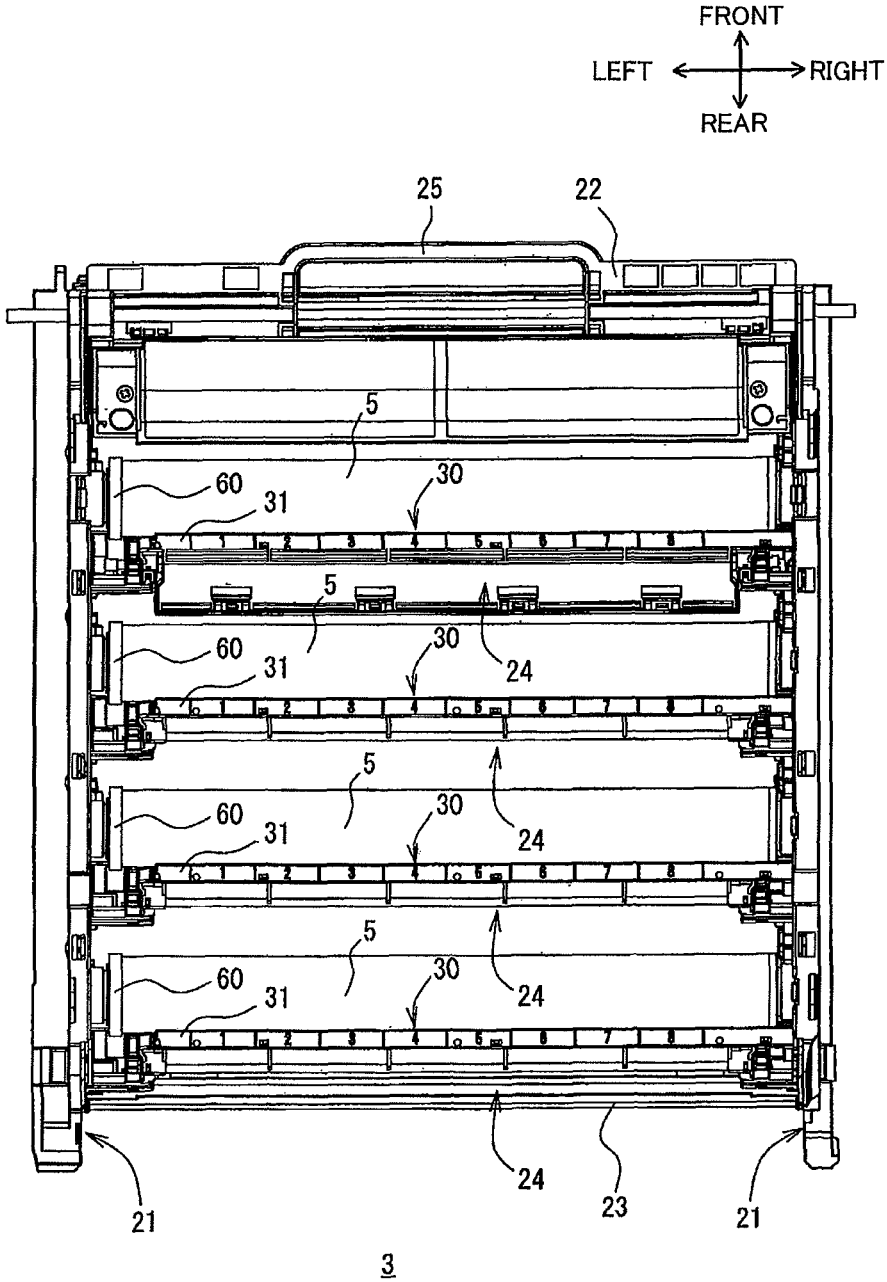
FIG. 2 is a bottom view of a drum unit according to the embodiment.

As shown in FIG. 2, the drum unit 3 includes a pair of side plates 21 arranged parallel to each other and separated in the width direction (the left-to-right direction), a front beam 22 bridging the front end parts of the side plates 21, a rear beam 23 bridging the rear end parts of the side plates 21, and four frame members 24 arranged between the front beam 22 and rear beam 23 and also bridging the side plates 21.

In the following description referring to FIGS. 2 through 5, left and right sides of the drum unit 3 will be based on the perspective of a user facing the front of the drum unit 3 after removing the drum unit 3 from the main casing 2 and flipping the drum unit 3 upside down so that the bottom surface of the drum unit 3 faces upward.

The four photosensitive drums 5 are disposed in parallel and at regular intervals in the front-to-rear direction between the front beam 22 and rear beam 23. The axial ends of each photosensitive drum 5 are rotatably held in the side plates 21.

The front beam 22 is formed of a synthetic resin material. A front-side handle 25 is integrally formed on the front beam 22 at a position in the widthwise center of the same. The handle 25 has a U-shape in a plan view, with both ends of the handle 25 coupled to the front beam 22. The handle 25 protrudes farther forward than the front beam 22.

The rear beam 23 is also formed of a synthetic resin.

When the front cover 4 (see FIG. 1) is in an open state, an operator can grip the handle 25 and slide the drum unit 3 in the front and rear directions relative to the main casing 2. Once the drum unit 3 has been pulled out from the main casing 2 to the extent that the rear beam 23 is positioned at the front edge of the main casing 2, the operator can remove the drum unit 3 from the main casing 2.

Each of the frame members 24 is disposed on the rear side of one of the photosensitive drums 5 and opposes the peripheral surface of the photosensitive drum 5. The frame members 24 are formed in a plate shape elongated in the left-to-right direction.

A graduated strip 30 is formed on a part of each frame member 24 adjacent to the image-forming region of a corresponding photosensitive drum 5. The graduated strip 30 is marked with a plurality (eight, for example) of divisions at equal intervals in the left-to-right direction. A symbol such as a number ("1" through "8", for example) is engraved in each of the divisions of the graduated strip 30. If the image-forming region of the photosensitive drum 5 were also divided in the left-to-right direction (along the axis of the photosensitive drum 5) into regions having the same width as the divisions of the graduated strip 30 engraved with numbers 1 through 8, the divided regions of the photosensitive drum 5 would have a one-on-one correspondence with the engraved portions of the graduated strip 30.

A color indicator part 31 is formed on the right end of each frame member 24. The letter "K" is engraved in the color indicator part 31 of the frame member 24 disposed on the rear side of the black photosensitive drum 5; the letter "Y" is engraved in the color indicator part 31 of the frame member 24 disposed on the rear side of the yellow photosensitive drum 5; the letter "M" is engraved in the color indicator part 31 of the frame member 24 disposed on the rear side of the magenta photosensitive drum 5; and the letter "C" is engraved in the color indicator part 31 of the frame member 24 disposed on the rear side of the cyan photosensitive drum 5.

Figure 3:
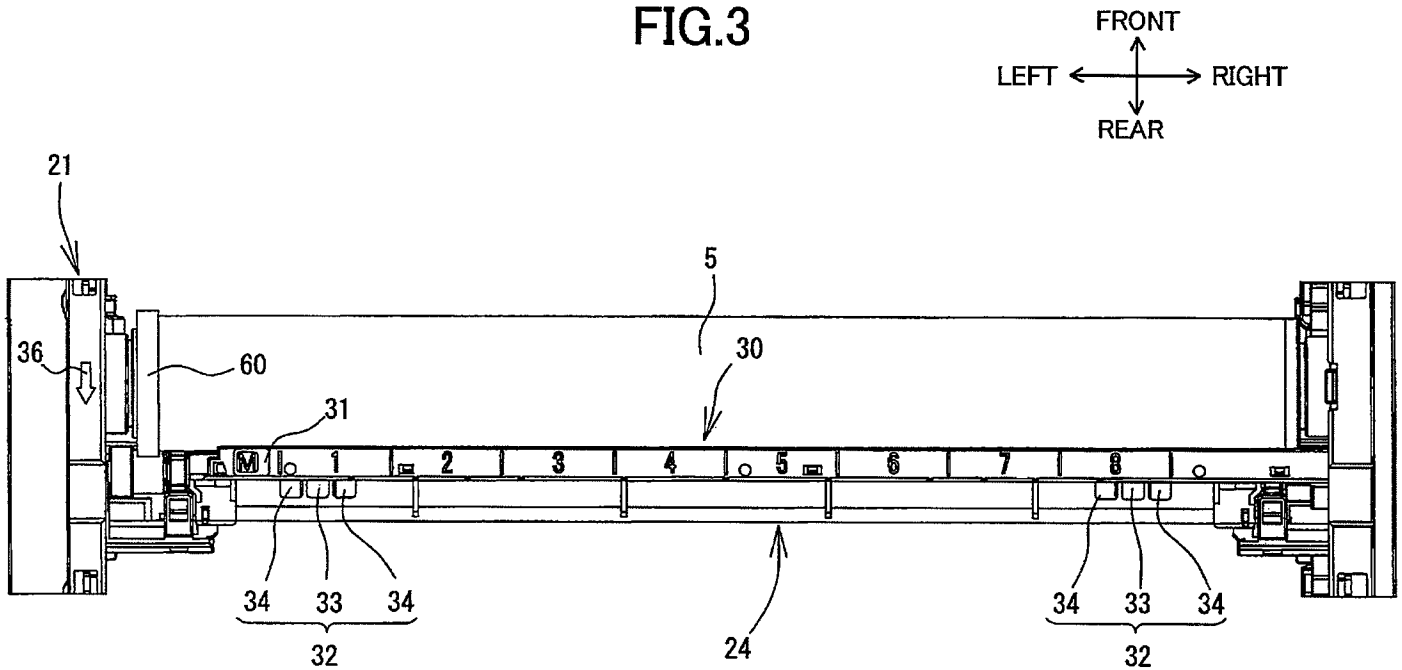
FIG. 3 is a bottom view of a frame member according to the embodiment.
Figure 4:
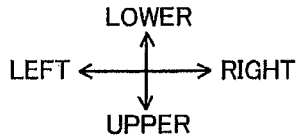
FIG. 4 is a back view of a main portion of the frame member according to the embodiment.
Figure 4:
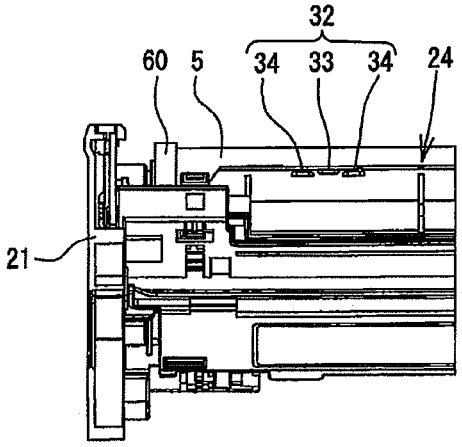

As shown in FIGS. 3 and 4 (not shown in FIG. 2), holding parts 32 are formed one on each end of each frame member 24. Each holding part 32 includes a first protrusion 33 protruding rearward from the rear edge of the frame member 24, and two second protrusions 34 also protruding rearward from the rear edge of the frame member 24 at positions on each side of the first protrusion 33.

Each of the first and second protrusions 33 and 34 has a rectangular plate shape that extends in the left-to-right and front-to-rear directions. As shown in FIG. 4, the left and right edges of the first protrusion 33 are formed as sloped surfaces that slope upward toward the outer side. The second protrusions 34 are disposed slightly below the corresponding first protrusion 33. The edge of each second protrusion 34 opposing the first protrusion 33 is also formed as a sloped surface that slopes downward toward the first protrusion 33.

As shown in FIG. 3, arrows 36 are formed on the bottom surface of the right side plate 21 in regions aligned with the photosensitive drums 5 in the left-to-right direction. The arrow 36 is an example of a symbol for indicating the rotational direction of the photosensitive drum 5.

As shown in FIGS. 2 through 5, a drum gear 60 is disposed on the right end of each photosensitive drum 5. During a drum checking operation described later, the user can rotate a photosensitive drum 5 by turning the corresponding drum gear 60 in the direction indicated by the arrow 36.

3. Check Sheet

Figure 5:
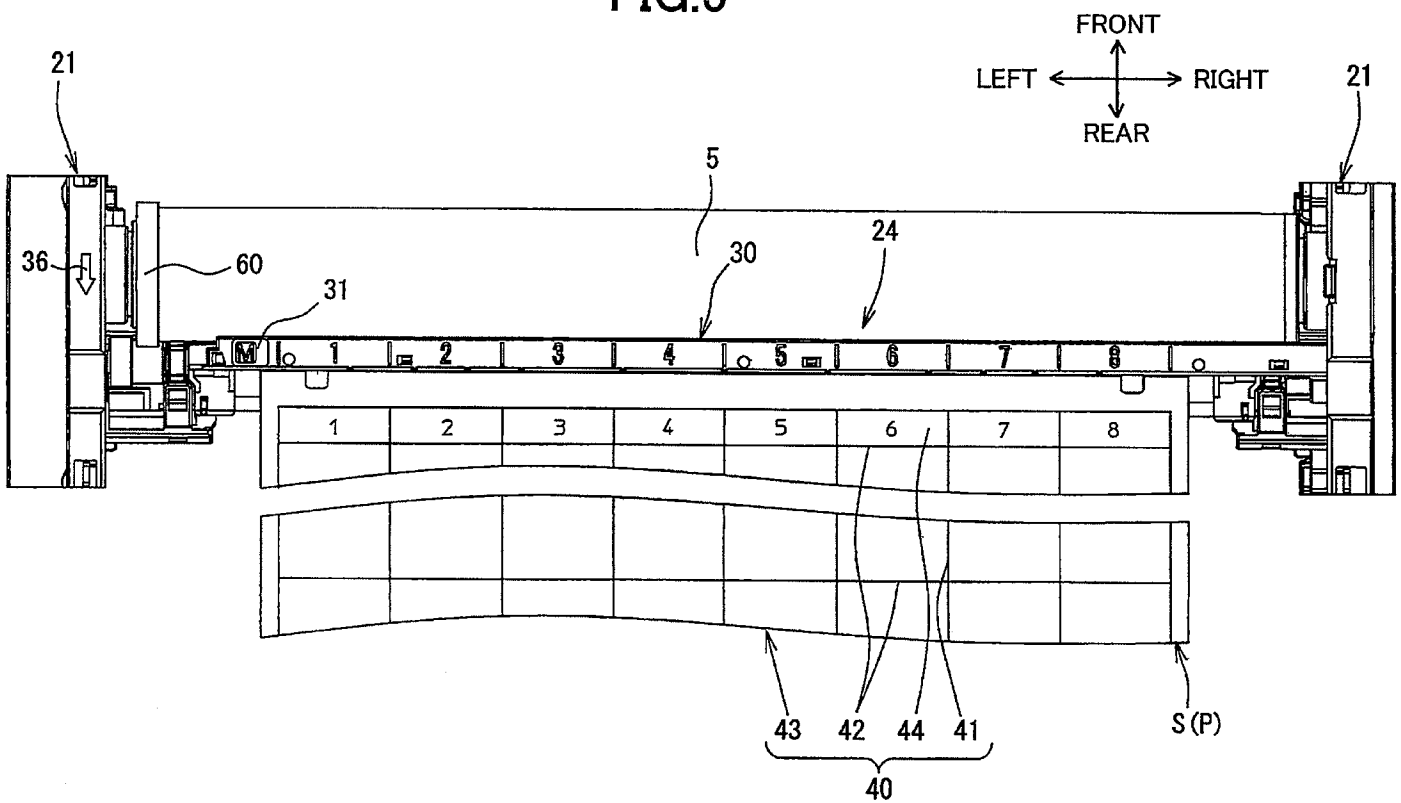
FIG. 5 is a bottom view of the frame member to which a check sheet is attached.

By switching the printer 1 from an image-forming mode to a maintenance mode, it is possible to print a check image 40, such as that shown in FIG. 5, on a sheet of paper P for identifying the location of deposited matter stuck to a photosensitive drum 5. In the example of FIG. 5, the check image 40 includes a large rectangular frame divided into cells by a plurality of vertical rules 41 and horizontal rules 42.

The vertical rules 41 are formed at intervals equivalent to the intervals of divisions in the graduated strip 30 formed on each frame member 24. Thus, the vertical rules 41 divide the outer frame of the check image 40 into a plurality of divided regions 43 having the same width as the divisions in the graduated strip 30.

The horizontal rules 42 are also formed at regular intervals and extend in a direction orthogonal to the vertical rules 41. The gap between any two neighboring horizontal rules 42 is equivalent to the circumferential length of the photosensitive drum 5.

A number printing area 44 is also provided in the check image 40 with numbers (1-8 in this example) corresponding to the numbers engraved in the graduated strip 30.

Figure 6:
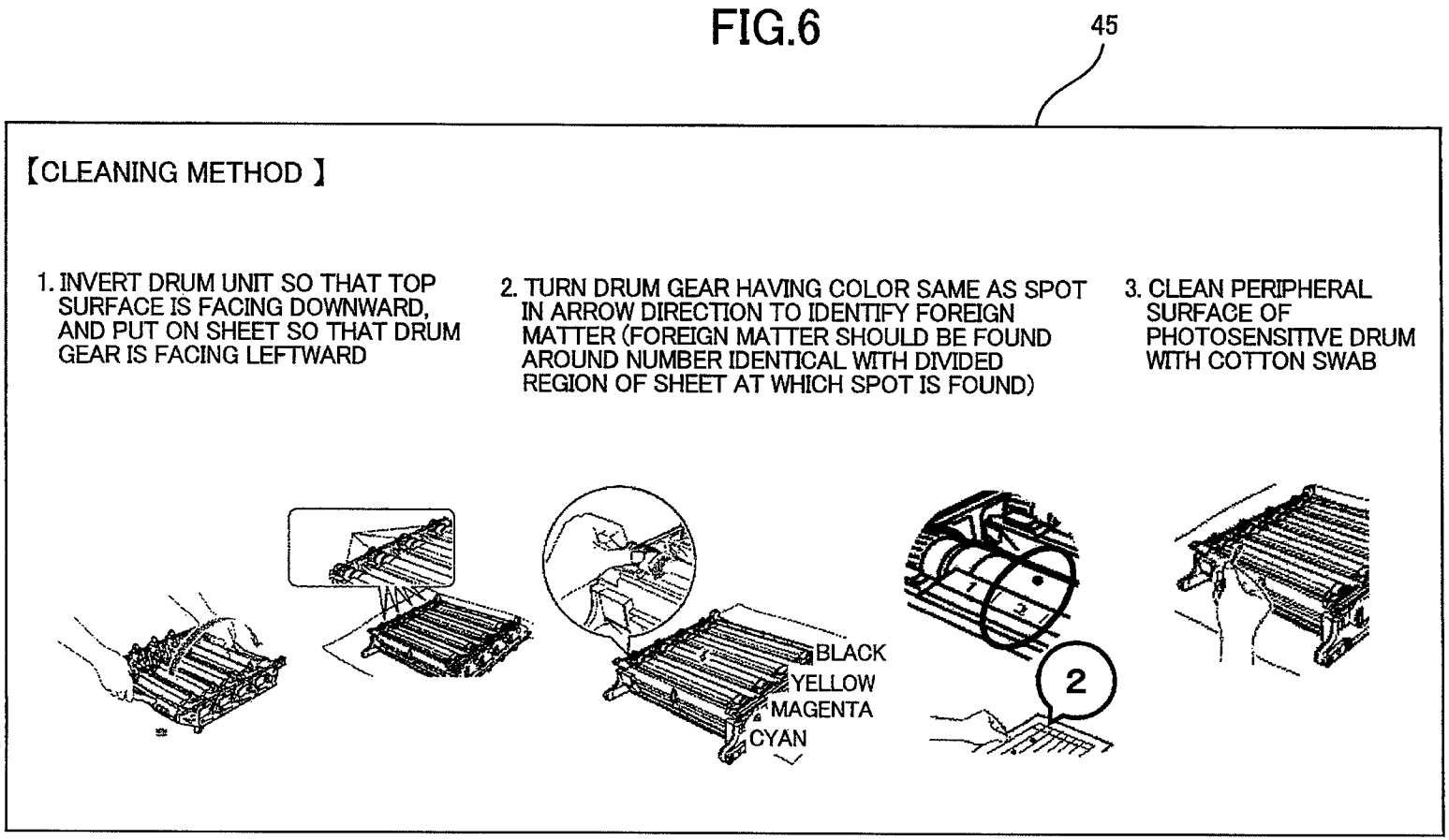
FIG. 6 is an example view of an instruction according to the embodiment.

As shown in FIG. 6, instructions 45 describing the procedure for cleaning the photosensitive drums 5 are also printed on the sheet of paper P having the check image 40 (hereinafter, the paper P printed with the check image 40 will be referred to as a "check sheet S").

During a drum checking operation, one edge of the check sheet S is held in the holding parts 32 so that the divided regions 43 defined by the vertical rules 41 correspond to the divisions in the graduated strip 30 of the frame member 24, as shown in FIG. 5. At this time, the check sheet S is attached by interposing one edge thereof between the first protrusions 33 and corresponding second protrusions 34 so that the edge is above the first protrusions 33 and below the second protrusions 34.

4. Electrical Structure of the Printer

Figure 7:
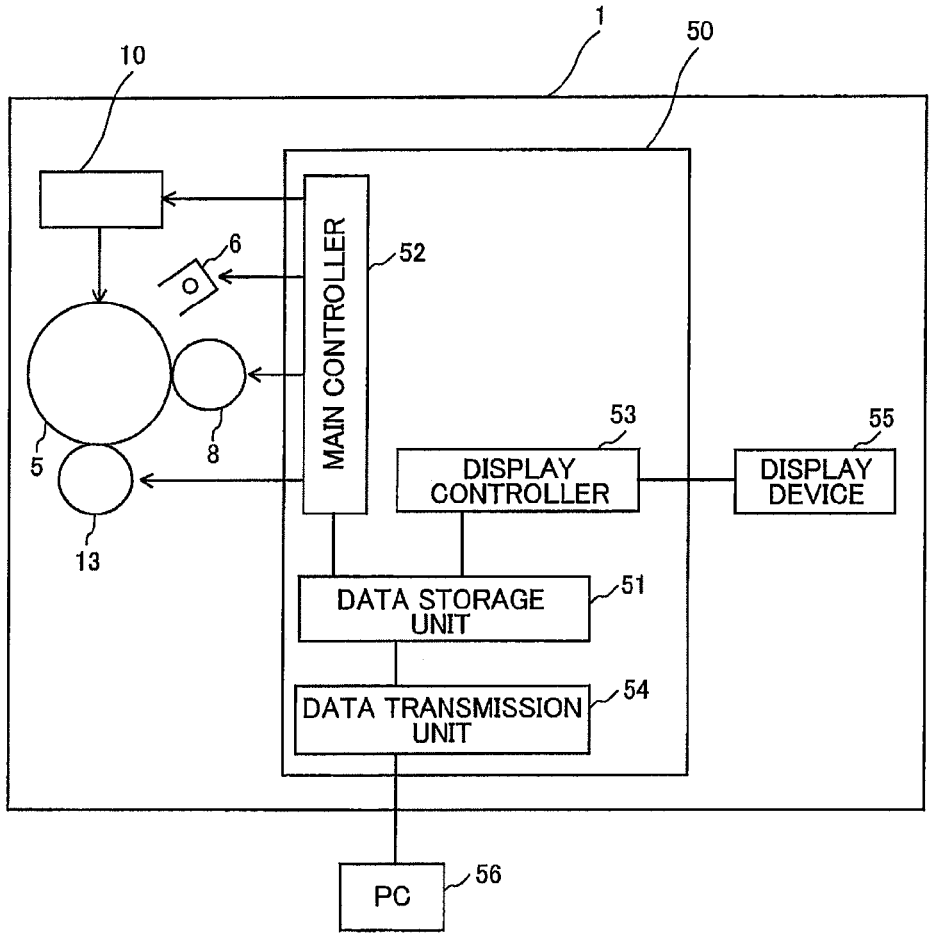
FIG. 7 is a block diagram showing an electrical configuration of the printer according to the embodiment.

As shown in FIG. 7, the printer 1 also includes a microcomputer 50 configured with a CPU, memory, and the like.

One area of memory allocated in the microcomputer 50 functions as a data storage unit 51. The data storage unit 51 stores image data for the check image 40 (see FIG. 5) and the instructions 45 (see FIG. 6) to be printed on a sheet of paper P for the drum checking operation.

The microcomputer 50 is essentially configured of a main controller 52, a display controller 53, and a data transmission, unit 54. These components of the microcomputer 50 are implemented in software through programs executed by the CPU.

The main controller 52 controls the chargers 6, developing rollers 8, exposure device 10, and transfer rollers 13 through drive circuits (not shown) based on image data inputted from an input device (not shown).

The main controller 52 can also switch the operating mode of the printer 1 based on input from the input device. This operating mode can be switched between a normal image-forming mode and a maintenance mode for forming the check image 40 (see FIG. 5) on a sheet of paper P.

In the maintenance mode, image data for the check image 40 stored in the data storage unit 51 is inputted into the main controller 52, and the main controller 52 controls the chargers 6, developing rollers 8, exposure device 10, and transfer rollers 13 based on this image data. Through this control process, the check image 40 is formed on a sheet of paper P to produce a check sheet S.

The printer 1 is also provided with a display device 55 for displaying various data.

The display controller 53 sequentially displays each step in a drum cleaning operation (described later) that is detailed in the instructions 45, for example, on the display device 55 based on image data saved in the data storage unit 51.

A personal computer (PC) 56 capable of communicating and exchanging data with the printer 1 is connected to the printer 1 wirelessly or with a cable.

The data transmission unit 54 transmits data signals to the PC 56 based on image data for the instructions 45 saved in the data storage unit 51. Accordingly, by operating the PC 56, the user can display an image of the instructions 45 on the monitor (not shown) of the PC 56 based on data signals inputted from the data transmission unit 54. The user can also transfer the data signals to a separate printer connected to the PC 56 to obtain a printout of the instructions 45.

5. Photosensitive Drum Maintenance

When spots (undesirable toner images) are formed on a sheet of paper P discharged onto the discharge tray 15 (see FIG. 1), the user may perform an operation on an input device (not shown) provided on the printer 1 to switch the printer 1 from the image-forming mode to the maintenance mode.

In the maintenance mode, the printer 1 forms the check image 40 (see FIG. 5) on a sheet of paper P and discharges the resulting check sheet S onto the discharge tray 15. The printer 1 performs this operation either automatically or in response to user-input on the input device. At this time, the printer 1 may also print the instructions 45 (see FIG. 6) on the check sheet S together with the check image 40.

After the check sheet S is discharged onto the discharge tray 15, the user opens the front cover 4 on the printer 1 (see FIG. 1) and pulls the drum unit 3 outward. Before removing the drum unit 3 completely from the main casing 2, the user removes all developer cartridges 7 from the drum unit 3.

Next, the user inverts the drum unit 3 so that the top surface is facing downward.

Next, the user inspects the check sheet S discharged on the discharge tray 15 for spots, noting the color and positions of the spots.

Since the printer 1 does not form any images other than the check image 40 and instructions 45 on the check sheet 5, the user can easily identify any undesirable spots formed on the check sheet S due to toner or other deposited matter that is sticking to one of the photosensitive drums 5. Since the spots will have the same color as the color of toner transferred by the offending photosensitive drum 5, the user can identify the photosensitive drum 5 to which deposited matter is stuck based on the color of the spots.

After identifying the photosensitive drum 5 that needs to be cleaned, the user attaches the check sheet S to the frame member 24 provided on the rear side of the photosensitive drum 5 in question (see FIG. 5). The edge of the check sheet S is attached to the holding parts 32 of the frame member 24 by inserting the edge of the check sheet S so that the edge is above the first protrusions 33 and below the second protrusions 34.

As described earlier, the check sheet S is divided by vertical rules 41 in the left to right direction to form a plurality of divided regions 43. Accordingly, the user can easily identify the divided region 43 in which a spot was produced on the check sheet S. Further, when the check sheet S is attached to the frame member 24, the divided regions 43 on the check sheet S are aligned with corresponding divisions of the graduated strip 30. Therefore, the user can identify the area of the photosensitive drum having deposited matter since this area will be aligned with the divided region 43 that contains the offending spot.

Next, the user checks the peripheral surface of the photosensitive drum 5 in the area corresponding to the divided region 43 with the offending spot while rotating the photosensitive drum 5 in the direction of the arrow 36 formed on the bottom surface of the side plate 21. The user rotates the photosensitive drum 5 by turning the drum gear 60 provided on the right end thereof.

Upon identifying the toner or other foreign matter stuck to the peripheral surface of the photosensitive drum 5, the user removes the deposited matter by cleaning the peripheral surface of the photosensitive drum 5 with a cotton swab or the like.

Next, the user detaches the check sheet S from the frame member 24 and remounts the drum unit 3 in the main casing 2 according to the reverse procedure of that described above.

6. Operations and Effects

As described above, the main controller 52 controls the chargers 6, developing rollers 8, exposure device 10, and transfer rollers 13 to form the check image 40 on a sheet of paper P. With the check image 40, the user can identify regions of the paper P in which toner images were transferred as one of the plurality of divided regions 43 juxtaposed along the axis of the photosensitive drum 5. The graduated strips 30 of the drum unit 3 are also engraved with the numbers 1 through 8 for identifying regions on the peripheral surfaces of the respective photosensitive drums 5 that correspond to each of the divided regions 43.

When undesirable foreign matter, such as toner, becomes stuck to the peripheral surface of a photosensitive drum 5, the printer 1 forms a check sheet S by printing the check image 40 on a sheet of paper P. At this time, spots or blemishes caused by the foreign matter stuck to a photosensitive drum 5 are also formed on the check sheet S together with the check image 40. Accordingly, the user can identify the divided region 43 of the check image 40 in which the spots were formed.

Further, numbers 1-8 corresponding to the divided regions 43 are engraved in the graduated strips 30 of the drum unit 3. Using the correspondence between the divided region 43 in which the spots were formed and the numbered area on the graduated strip 30, the user can identify the region on the peripheral surface of the photosensitive drum 5 corresponding to the numbered region. As a result, the user can easily identify the position of foreign matter adhering to the peripheral surface of the photosensitive drum 5.

Further, the check image 40 has straight lines (the vertical rules 41) separating the divided regions 43 for clearly demarcating the same. Accordingly, a user 10, can accurately distinguish each divided region 43 through the check image 40.

The check image 40 also includes the horizontal rules 42 formed on the check sheet S at intervals equivalent to the circumferential length of the photosensitive drum 5, thereby demarcating the divided regions 43 at lengths equivalent to the circumferential length of the photosensitive drum 5. Hence, when a blemish is formed on the check sheet S repeatedly at intervals equivalent to the intervals between neighboring horizontal rules 42, the user can determine that matter is stuck to the peripheral surface of the photosensitive drum 5.

The instructions 45 are also formed on the check sheet S for describing the steps for removing foreign matter from the peripheral surface of the photosensitive drum 5. Hence, when removing foreign matter from the photosensitive drums 5, the user need not consult a manual or otherwise prepare instructions separately, thereby facilitating the process for removing the foreign matter.

The data storage unit 51 saves image data for the instructions 45. Hence, the user can easily obtain the instructions 45 by outputting the image data stored in the data storage unit 51.

The display controller 53 may also display an image on the display device 55 based on the data stored in the data storage unit 51. Accordingly, an image of the instructions 45 can be displayed on the display device 55, eliminating the need to obtain the instructions by some other means when performing a drum cleaning operation.

Further, the data transmission unit 54 can transmit the data saved in the data storage unit 51 to an external device, such as the PC 56. Accordingly, the user of the external device can output the data received from the data transmission unit 54 to obtain the instructions 45 on how to remove foreign matter from the photosensitive drums 5.

A side plate 21 of the drum unit 3 is marked with arrows 36 to indicate the rotating direction of the photosensitive drums 5. These marks can help remind the user not to rotate the photosensitive drums 5 in reverse when the user is removing foreign matter from the photosensitive drums 5.

Each frame member 24 in the drum unit 3 is provided with holding parts 32 for holding the check sheet S behind the corresponding photosensitive drum 5. With the check sheet S gripped in the holding parts 32, the user can compare the check image 40 with the numbers 1-8 inscribed in the corresponding graduated strip 30 of the drum unit 3 for reliably identifying the area of the photosensitive drum 5 on which foreign matter is stuck.

The toner color corresponding to each photosensitive drum 5 is indicated by the color indicator parts 31 formed on the right ends of the respective frame members 24. Accordingly, the user can identify the photosensitive drum 5 on which foreign matter is deposited based on the color indicator part 31 that matches the color of spots formed on the check sheet S.

A color printer is capable of forming color images in diverse colors by superimposing toner images in the four colors black, yellow, magenta, and cyan, for example. If spots or blemishes are produced on a sheet of paper P when forming a color image thereon, a spot formed of a single color may be overlapped with an image (or images) in another color (or colors), resulting in spots of a mixed color on the paper P. In this case, the user cannot easily determine the photosensitive drum 5 that has foreign matter stuck thereto based on the color of the spots.

Consequently, in the preferred embodiment, only the check image 40 and instructions 45 are printed on the check sheet S. Accordingly, the spot produced on the check sheet S will be of a single color corresponding to the photosensitive drum 5 on which the foreign matter is stuck, enabling the user to identify the photosensitive drum 5 with foreign matter adhering thereto based on the color of the spots.

7. Variations of the Embodiment

While the invention has been described in detail with reference to specific embodiments thereof, it would be apparent to those skilled in the art that many modifications and variations may be made therein without departing from the spirit of the invention, the scope of which is defined by the attached claims.

For example, while the instructions 45 are printed on the check sheet S together with the check image 40 in the preferred embodiment described above, it is not necessary to form the instructions 45 on the check sheet S if the instructions 45 are displayed on the display device 55 or outputted to the PC 56 or other external device. By eliminating the instructions 45 from the check sheet S, more space on the check sheet S can be allocated for forming the check image 40.

Further, when the instructions 45 are printed on the check sheet S, the display controller 53 need not transfer data to the display device 55 for displaying the instructions 45 on the display device 55, and/or the data transmission unit 54 need not transmit similar data to the PC 56.

In the preferred embodiment, the graduated strip 30 of each frame member 24 is divided into eight regions. However, the number of divisions on the graduated strip 30 may be set to any integer number of two or greater, provided that the divisions help the user quickly identify the position of foreign matter stuck to the peripheral surface of the corresponding photosensitive drum 5.

In the preferred embodiment, numbers 1 through 8 are used as an example of the symbols engraved in the divisions of the graduated strip 30. However, other symbols may be employed, including other numbers, alphabetic characters, icons (marks), and the like, provided that the symbols can uniquely identify each division of the graduated strip 30.

The image-forming device is a color printer in the preferred embodiment described above, but a monochromatic printer may be used as the image-forming device instead. In this case, the drum unit according to the present invention may be applied to a process cartridge holding the photosensitive drum, whereby the process cartridge is detachably mounted in the monochromatic printer.

What is claimed is:

1. An image-forming device comprising:

a main casing;

a drum unit detachable from the main casing and including a photosensitive drum having a rotational axis extending in an axis direction, the drum unit being formed with a plurality of symbols juxtaposed along the axis direction;

an image-forming unit that forms an image on the photosensitive drum in an image-forming mode; and a transfer unit that transfers the image onto the photosensitive drum onto a sheet, wherein the image-forming unit forms a particular developer image on the photosensitive drum in a maintenance mode, the first developer image transferred onto the sheet dividing the sheet into a plurality of regions along the axis direction, the plurality of regions corresponding to the plurality of symbols, respectively.

2. The image-forming device according to claim 1, wherein the particular developer image includes a first straight line dividing the sheet into the plurality of regions.

3. The image-forming device according to claim 1, wherein the image-forming unit further forms a further developer image on the photosensitive drum in the maintenance mode, the further developer image including a plurality of straight lines extending in the axis direction at a length equivalent to a circumferential length of the photosensitive drum.

4. The image-forming device according to claim 1, wherein the image-forming unit further forms a certain developer image on the photosensitive drum in the maintenance mode, the certain developer image indicating steps for removing foreign matter stuck to the photosensitive drum.

5. The image-forming device according to claim 1, further comprising a storing unit that stores data indicative of steps for removing foreign matter stuck to the photosensitive drum.

6. The image-forming device according to claim 5, further comprising a display unit that displays an image based on the data stored in the storing unit.

7. The image-forming device according to claim 5, further comprising a data transmission unit that transmits the data stored in the storing unit to an external device.

8. The image-forming device according to claim 1, wherein the drum unit is marked with an arrow indicative of a rotating direction of the photosensitive drums.

9. The image-forming device according to claim 1, wherein the drum unit further includes a holding unit for holding the sheet on which the particular developer image is formed so that the plurality of regions is opposed to the plurality of symbols, respectively.

10. The image-forming device according to claim 1, wherein the drum unit includes a plurality of photosensitive drums, each photosensitive drum being used for forming an image having a color different from one another.

* * * * *